United States Patent [19]

Streich et al.

[11] 4,139,830

[45] Feb. 13, 1979

[54] ELECTROMAGNETIC SWITCHING APPARATUS INCLUDING IMPROVED MEANS FOR MECHANICALLY LATCHING A CONTACT BRIDGE CARRIER

[75] Inventors: Georg Streich, Amberg; Günter Gnahn, Sulzbach, both of Fed. Rep. of Germany

[73] Assignee: Siemens Aktiengesellschaft, Munich, Fed. Rep. of Germany

[21] Appl. No.: 802,460

[22] Filed: Jun. 1, 1977

[30] Foreign Application Priority Data

Jun. 4, 1976 [DE] Fed. Rep. of Germany ..... 2625292

[51] Int. Cl.[2] ..... H01H 3/02; H01H 3/04

[52] U.S. Cl. ..... 335/191; 335/190; 74/520

[58] Field of Search ..... 335/191, 190, 189, 175, 335/132; 74/520; 200/153 G

[56] References Cited

U.S. PATENT DOCUMENTS

| | | | |
|---|---|---|---|
| 2,513,934 | 7/1950 | Hall | 335/190 |
| 2,523,774 | 9/1950 | Moran | 335/190 |
| 3,217,125 | 11/1965 | Brackett | 335/190 |
| 3,436,710 | 4/1969 | Stokes | 335/190 |
| 3,768,052 | 10/1973 | Bühler et al. | 335/190 |

*Primary Examiner*—Harold Broome

*Attorney, Agent, or Firm*—Kenyon & Kenyon, Reilly, Carr & Chapin

[57] ABSTRACT

A remotely-controllable electromagnetic switching apparatus including a housing, a contact bridge carrier disposed within the housing, and means for mechanically latching the contact bridge carrier by locking the contact bridge carrier in an operative switching position by means of a first lever member which is movable into a return-movement region of the contact bridge carrier by means of a spring force and is pivotably coupled to a second lever member. The improvement comprises the lever members comprising toggle levers which are movable into an almost fully-extended, beyond dead-center position for blocking return movement of the contact bridge carrier into the return movement region. At least one of the toggle levers is coupled to and guided by rollers which engage the housing of the switching apparatus.

8 Claims, 9 Drawing Figures

ELECTROMAGNETIC SWITCHING APPARATUS INCLUDING IMPROVED MEANS FOR MECHANICALLY LATCHING A CONTACT BRIDGE CARRIER

BACKGROUND OF THE INVENTION

1. Field of the Invention

This invention relates to a remotely-controllable electromagnetic switching apparatus which can be mechanically latched by locking a component of the switching apparatus which carries out the switching motion in an operative position by means of a lever member which is movable into a return-motion region of the component by means of a spring force and which is pivotably coupled to another lever member.

2. Description of the Prior Art

Electromagnetic switching apparatus of the foregoing type are known in the art. For example, U.S. Pat. No. 3,466,577 describes an apparatus in which the pawl of a lever member is moved into the region of motion of an angle member coupled to the contact bridge carrier of the apparatus in the switched-on position of the switching apparatus. The one lever member pulls along with it a second lever member which is pivotably coupled to the first out of the area adjacent the plunger of a locking magnet to lock it in a switched-on position. The disadvantage of this arrangement is that not only wear at the pawl but also wear at the plunger occurs so that the apparatus is suitable only for a small number of switching cycles. As the wear increases, the position of the locked armature is no longer equivalent to the switched-on position of the armature, i.e., the push-through pressure for the contacts of the apparatus to be operated is reduced in the locked position of the armature.

SUMMARY OF THE INVENTION

It is therefore an object of the present invention to overcome the aforementioned disadvantages of heretofore known electromagnetic switching apparatus and to provide an improved remotely-controllable electromagnetic switching apparatus including means for mechanically latching the contact bridge carrier of the apparatus which is simple in design and permits a relatively large number of switching cycles.

These and other objects of the invention are achieved in a remotely-controllable electromagnetic switching apparatus including a housing, a contact bridge carrier disposed within the housing, and means for mechanically latching the contact bridge carrier by locking the contact bridge carrier in an operative switching position by means of a first lever member which is movable into a return-movement region of the contact bridge carrier by means of a spring force and is pivotably coupled to a second lever member. The improvement comprises the lever members comprising toggle levers which are movable into an almost fully-extended, beyond dead-center position for blocking return movement of the contact bridge carrier into the return movement region. At least one of the toggle levers is coupled to and guided by rollers which engage the housing of the switching apparatus.

The apparatus may further comprise means for adjusting the length of one of the toggle levers. This is advantageous in that the latching can be adapted to desired requirements, and, in particular, this assures that the latching takes place in the exact setting of the switching apparatus. The adjusting means may further include a compression spring disposed between the rollers and one of the toggle levers so that adjustment of the length of the one of the toggle levers is made against the force of the compression spring. The advantage of this is that tolerances can be compensated for in a simple manner.

The electromagnetic switching apparatus may further comprise magnet means for moving the toggle levers from the almost fully-extended position of the levers to another position and thereby resetting the levers. The toggle levers and the resetting magnet means are assembled as a subassembly which is mountable on the switching apparatus when the contact bridge carrier is disposed in an unlocked position. In this arrangement, the other of the toggle levers is disposed in engagement with the contact bridge carrier when the carrier is disposed in its operative switching position, i.e., its switched-on position. This design permits universal application of the latching device in any type of switching equipment. The apparatus also may comprise means mounted in the subassembly for manually moving the toggle levers into their reset position for permitting manual resetting of the levers as well as removal of the latching of the carrier in the event there is no voltage for operating the magnet means.

The switching apparatus includes fixed contacts disposed within the housing and movable contacts disposed on the contact bridge carrier which form a make contact for the switching apparatus. In order to obtain a further substantial saving in overall volume of the switching apparatus, electrical transmission means is preferably coupled to the magnet means by means of the make contact formed by the fixed and movable contacts of the switching apparatus. This design makes it possible to design the resetting magnet means for a duty cycle of less than 10%.

The switching apparatus may additionally further comprise electrically-conductive fastening members which are electrically coupled to the resetting magnet means for fastening the subassembly to the fixed contacts of the switching apparatus. This enables the subassembly to be mounted on the apparatus with little effort. This design also makes it possible to achieve mechanical connection of the subassembly simultaneously with the electrical connection thereof.

These and other novel features and advantages of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
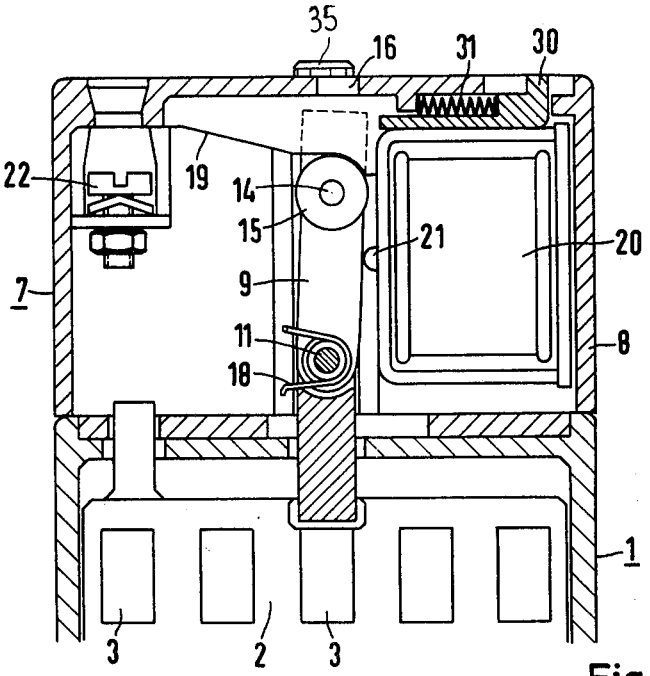
FIG. 1 is a partial, cross-sectional front view of one embodiment of an improved electromagnetic switching apparatus constructed according to the present invention.

Referring now to the drawings, there is shown an electromagnetic switching apparatus including a housing 1 containing a fixed magnet part, an actuating coil, and a switching magnet part (all not shown). A contact bridge carrier 2 is coupled to the switching magnet part of the apparatus and includes openings 3 in which a plurality of contact bridges 4 are secured by means of springs 5. The contact bridges include movable contacts which cooperate with and engage fixed contacts 6 disposed in housing 1. Another switching apparatus housing 8 containing a subassembly 7 is mounted on housing 1. The subassembly consists of a toggle joint comprising toggle levers 9 and 10. The toggle levers are pivotably coupled to one another by means of a pin 11. Toggle lever 10 has the shape of a fork and encloses toggle lever 9. A compression spring 12 is disposed within toggle lever 9 in a cup-shaped recess 13 provided therein and is braced on one side against the bottom of the recess and engages on the other side a connecting shaft 14 for a pair of rollers 15. An adjustment screw 17 which is operable through an opening 16 provided in housing 8 permits the overall length of the toggle joint to be adjusted. Consequently, the distance of pin 11 from connecting shaft 14 can be adjusted. A spring 18 is wound around pin 11 and engages toggle lever 9 on one side and toggle lever 10 on the other side so that when the armature of the apparatus is pulled-up, i.e., if the contact bridge carrier is moved, the toggle joint is swung into the position illustrated in FIG. 1. Rollers 15 roll during this movement of the contact bridge carrier along surfaces 19 which are fixed relative to the housing of the switching apparatus so that the rollers bear against these surfaces and, by means of the force exerted by spring 18, stop moving at the end of surfaces 19 in such a manner that the toggle joint is disposed in an almost fully-extended position which is beyond the dead-center point along the direction of movement of toggle lever 9 and rollers 15. Toggle lever 10 engages and remains in engagement with contact bridge carrier 2 in this position so that return movement of the contact bridge carrier is prevented. Since the toggle joint is rigid, relatively large forces can be brought to bear to hold the contact bridge carrier in a switched-on position, i.e., the compression spring 12 must be strong enough so that the back pressure springs which act on the contact bridge carrier are overcome. An electromagnet 20 is provided for kicking the toggle joint out of its almost fully-extended position and resetting the toggle joint. A plunger 21 of electromagnet 20 acts on toggle lever 9 and if the back pressure springs for the contact bridge carrier 2 are operative, i.e., if the switching apparatus is not switched on, rollers 15 glide from the almost fully-extended position illustrated in FIG. 1 into their original, reset position illustrated in FIG. 3.

Figure 9:
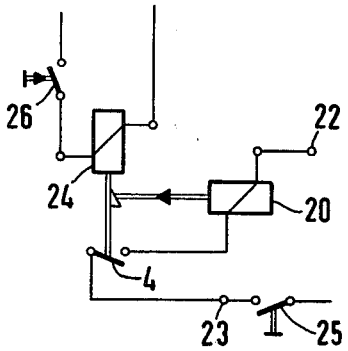
FIG. 9 is an electrical schematic diagram of the improved electromagnetic switching apparatus constructed according to the present invention.
Figure 7:
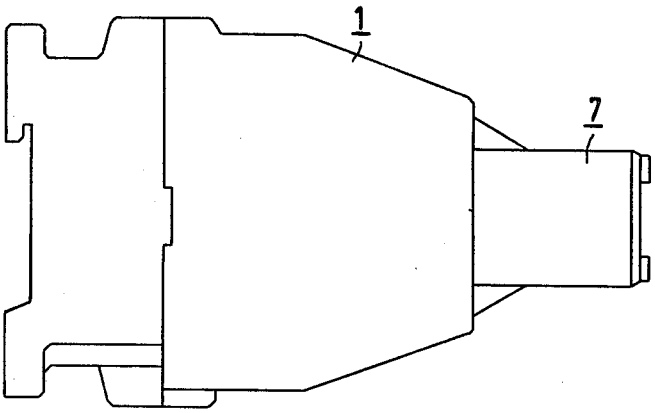
FIG. 7 is a side view of the switching apparatus illustrated in FIG. 5.

The electrical wire leads for electromagnet 20 are coupled to the magnet by means of fixed contacts 6 and the movable contacts disposed on contact bridge 4 so that the current supply for the magnet is interrupted after the contact bridge carrier has moved into its rest position. The circuit for this arrangement is illustrated in FIG. 9. Terminals 22 and 23 are disposed in housing 8 and function, on the one hand, for coupling the coil 24 of electromagnet 20 disposed in housing 1 and, on the other hand, for supplying current to make contact 4. A switch 25 is provided for switching on electromagnet 20 and the operating element for the switching apparatus is identified by reference numeral 26. The electrical connection to the make contact formed by contact bridge 4 and fixed contacts 6 is achieved by means of angle members 27 which are coupled to the coil of magnet 20 and the lead wire to terminal 23, respectively. The angle members 27 are moved into electrically-conductive contact with fixed contacts 6 by screws 28 which are inserted in place of the terminal screws for the fixed contacts when the housing of subassembly 7 is attached to the switching apparatus.

In the embodiment of the invention illustrated in FIGS. 4 through 7, a leaf spring 29 is utilized instead of compression spring 13. In other respects, this embodiment of the invention corresponds to that illustrated in FIGS. 1 through 3. In order to move toggle lever 9 into an "off" position without using electromagnet 20, a handle 30 is movably guided in housing 8 and is movable from the exterior of the apparatus housing by means of a screwdriver or the like. The handle is held in a rest position by means of a spring 31.

Figure 2:
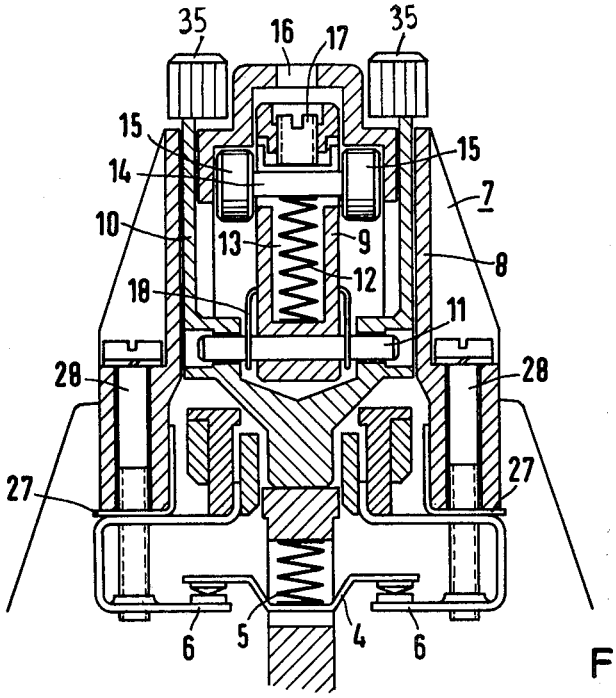
FIG. 2 is a cross-sectional side view of the switching apparatus illustrated in FIG. 1.
Figure 3:
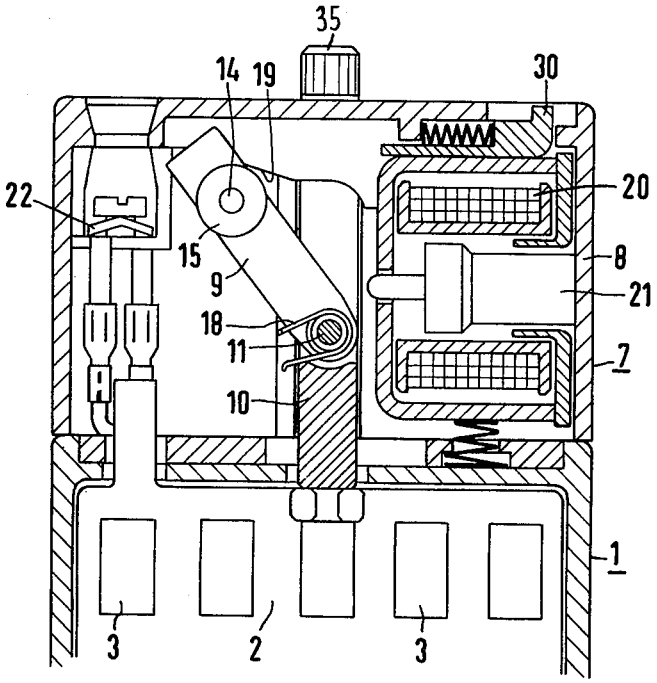
FIG. 3 is another cross-sectional front view of the switching apparatus illustrated in FIG. 1 showing the latching means of the apparatus in its unlocked position.
Figure 4:
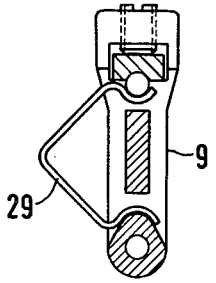
FIG. 4 is a cross-sectional view of another embodiment of a toggle lever for use in the switching apparatus illustrated in FIG. 1.
Figure 5:
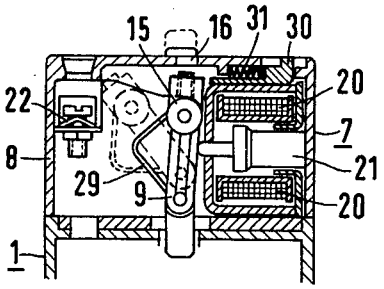
FIG. 5 is a partial, cross-sectional front view of another embodiment of an improved electromagnetic switching apparatus constructed according to the present invention using the embodiment of the toggle lever illustrated in FIG. 4.

In the embodiment of the invention illustrated in FIGS. 1–3, manual switching-on of the switching apparatus can also be achieved by exerting downward pressure on two caps 35 provided on toggle lever 10. (See FIG. 2.).

Figure 8:
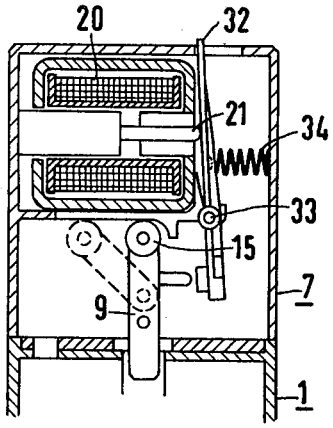
FIG. 8 is a partial, cross-sectional front view of another embodiment of an improved electromagnetic switching apparatus constructed according to the present invention.
Figure 6:
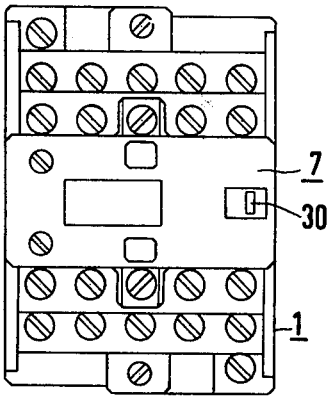
FIG. 6 is a top plan view of the switching apparatus illustrated in FIG. 5.

In the embodiment of the invention illustrated in FIG. 8, a spring-loaded intermediate lever 32 is interposed between plunger 21 and toggle lever 9. The lever is fulcrumed at a point 33 and is moved into the position illustrated in FIG. 8 by means of a spring 34. As soon as plunger 21 engages intermediate lever 32, the lever is swung outwardly against spring 34 and the toggle lever is rotated into a position indicated by the dashed lines in FIG. 8. Such an arrangement is advantageous if a make contact is not available or the duty cycle of the resetting magnet is not designed for 100%.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a remotely-controllable electromagnetic switching apparatus including a housing, a contact bridge carrier disposed within said housing, and means for mechanically latching said contact bridge carrier by locking said contact bridge carrier in an operative switching position in said housing, said latching means comprising a first lever member disposed within said housing which is movable into a return-movement region of said contact bridge carrier in said housing by means of a spring force and is pivotably coupled to a second lever member adapted for engagement with said carrier, the improvement comprising said lever members comprising toggle levers adapted for movement into an almost fully-extended, beyond dead-center position for blocking return movement of said contact bridge carrier into said return movement region in said housing, at least one of said toggle levers being coupled to and guided by rollers which engage said housing of said switching apparatus.

2. The improvement recited in claim 1, further comprising means, disposed within said housing and coupled to said toggle lever comprising said first lever member, for adjusting the position of said rollers with respect to said one of said toggle levers.

3. The improvement recited in claim 2, wherein said adjusting means includes a compression spring disposed between said rollers and said one of said toggle levers, said adjustment of said rollers with respect to said one of said toggle levers being made against the force of said compression spring.

4. The improvement recited in claim 1, further comprising magnet means, disposed in said housing adjacent to said one of said toggle levers for moving said toggle levers from said almost fully-extended position to another position and thereby resetting said toggle levers, and wherein said toggle levers and said resetting magnet means are assembled as a subassembly which is mountable on said switching apparatus when said contact bridge carrier is disposed in an unlocked position, said other of said toggle levers being disposed in engagement with said contact bridge carrier in said operative switching position of said carrier.

5. The improvement recited in claim 4, further comprising means disposed in said housing and mounted in said subassembly adjacent said one of said toggle levers for manually moving said toggle levers into said another position.

6. The improvement recited in claim 4, wherein said switching apparatus includes fixed contacts disposed within said housing and movable contacts disposed on said contact bridge carrier adapted for engagement with said fixed contacts, said fixed and movable contacts forming a make contact for said switching apparatus, and further comprising electrical transmission means coupled to said movable contacts and said magnet means, said magnet means being coupled in series relationship with said make contact formed by said fixed and movable contacts of said switching apparatus.

7. The improvement recited in claim 6, further comprising electrically-conductive fastening members, disposed in said housing in said subassembly and electrically coupled to said resetting magnet means, for fastening said subassembly to said fixed contacts of said switching apparatus.

8. The improvement recited in claim 4, further comprising means, coupled to said toggle lever comprising said second lever member, for manually moving said toggle levers to said almost fully-extended position, thereby moving said contact bridge carrier of said switching apparatus into said operative switching position.

* * * * *